US006399881B2

(12) United States Patent
Edelstein

(10) Patent No.: US 6,399,881 B2
(45) **Date of Patent: *Jun. 4, 2002**

(54) MULTI-SECTIONAL UTILITY POLE HAVING SLIP-JOINT CONICAL CONNECTIONS

(76) Inventor: Hans P. Edelstein, 1721 E. Hatcher St., Phoenix, AZ (US) 85020

( * ) Notice: Subject to any disclaimer, the term of this patent is extended or adjusted under 35 U.S.C. 154(b) by 0 days.

This patent is subject to a terminal disclaimer.

(21) Appl. No.: 09/780,090

(22) Filed: Feb. 9, 2001

Related U.S. Application Data

(63) Continuation of application No. 09/196,790, filed on Nov. 20, 1998, now Pat. No. 6,191,355.
(60) Provisional application No. 60/066,967, filed on Nov. 28, 1997.

(51) Int. Cl.[7] ..... E04H 12/18
(52) U.S. Cl. ..... 174/45 R; 52/726.3
(58) Field of Search ..... 174/45 R, 2, 3; 52/726.3, 726.4

(56) References Cited

U.S. PATENT DOCUMENTS 232,360 A * 9/1880 Milliken ..... 174/45 R
295,905 A * 4/1884 Brott ..... 174/45 R
909,299 A * 6/1909 Hilborn et al. ..... 174/45 R
1,018,754 A * 2/1912 Ford ..... 174/45 R
2,036,771 A * 4/1936 Pfisterhammer ..... 174/45 R
2,066,419 A * 1/1937 Pfisterhammer ..... 174/45 R
2,841,634 A * 7/1958 Kimball ..... 174/45 R
3,034,209 A * 5/1962 Biance et al. ..... 174/45 R
3,270,480 A * 9/1966 Beecker ..... 174/45 R
3,713,262 A * 1/1973 Jatcko ..... 52/726
3,936,206 A * 2/1976 Meisberger ..... 52/726
4,242,851 A * 1/1981 Pohlman et al. ..... 52/726

* cited by examiner

*Primary Examiner*—Dean A. Reichard
*Assistant Examiner*—Adolfo Nino
(74) *Attorney, Agent, or Firm*—Christopher, Weisberg & Crush, P.A.

(57) ABSTRACT

A multi-sectional utility pole includes at least two sections of straight pipe, which are joined and connected by a slip joint connection. The slip joint consists of two mating conical sections, with one attached to each section of the pole. The slip joint is compressed with the aid of rings, which are attached to the pipe, and a key and slot. The conical sections can be swaged from the ends of the pipe, or can be fabricated separately and welded on to the ends of the pipe.

14 Claims, 2 Drawing Sheets

MULTI-SECTIONAL UTILITY POLE HAVING SLIP-JOINT CONICAL CONNECTIONS

CROSS-REFERENCE TO RELATED APPLICATIONS

This application is a continuation of application Ser. No. 09/196,790, filed Nov. 20, 1998, now U.S. Pat. No. 6,191,355 which is based on and claims the benefit of U.S. Provisional Application No. 60/066,967, filed on Nov. 28, 1997, the contents of which are incorporated herein.

BACKGROUND OF THE INVENTION

1. Field of the Invention

The invention broadly relates to the field of sectional utility poles, and more particularly relates to the field of inter-connections for securing the sections of such poles.

2. Description of the Related Art

Multi-sectional utility poles are used for a variety of purposes such as highway luminaire supports and utility poles, e.g., telephone, cable and electrical. Poles of a given length are often designed in multiple sections to provide for an increased ease of transporting by truck, railroad, or even cargo plane. The length may also be restricted due to other field requirements. All such multi-section poles, however, must address the issues of joining each of the sections of pole to one another and appropriately securing the joints in the field during installation.

One common method of making multi-section poles is to use tubular sections which are uniformly tapered along their entire length such that the top is narrower than the bottom. These uniformly tapered sections are then secured to each other by sliding one section over another. The tapered sections are designed so that the bottom portion of a top section slides over the top portion of a bottom section. The portions of the two sections that are in contact, ideally, form a tight fit. There are several limitations associated with this technique.

Poles of this type are typically expensive to fabricate. Additionally, when assembling a pole vertically, it is necessary to suspend the upper sections one by one from a helicopter or crane or other device, which is expensive in terms of the equipment needed and in terms of the labor involved. Such an assembly process can also take a great deal of time. Further, the uniformly tapered sections can also be expensive to produce.

Another factor which can contribute to the cost and the time involved in assembly is a lack of fungibility between the sections. Insofar as the individual sections of a complete pole are designed to be used together for that specific pole, this requires additional sorting at the jobsite and can cause delays if the sections are not delivered in the proper order for assembly.

Accordingly, there is a need for a multi-sectional utility pole and a method of fabricating it which overcome these limitations.

SUMMARY OF THE INVENTION

Briefly, in accordance with one aspect of the invention, a multi-sectional utility pole comprises a lower pole support section and an upper pole support section. The lower pole support section comprises a top end, a bottom end, a top region which comprises the top end, a middle region, and a bottom region which comprises the bottom end. The middle region of the lower pole support section is not tapered, but the top region is tapered so that its circumference is decreased toward the top end. The upper pole support section also comprises a top end, a bottom end, a top region which comprises the top end, a middle region, and a bottom region which comprises the bottom end. The middle region of the upper pole support section is not tapered, but the bottom region is tapered so that its circumference is increased toward the bottom end. The increased circumference of the bottom region of the upper pole support section allows it to receive at least a portion of the top region of the lower pole support section. This arrangement allows the upper pole support section to be axially mounted on the lower pole support section.

Briefly, in accordance with another aspect of the invention, a method for making the multi-sectional utility pole above comprises the steps of forming the bottom region of the upper pole support section by swaging, and forming the top region of the lower pole support section by swaging. The bottom region of the upper pole support section is formed by swaging a bottom portion of the middle region of the upper pole support section. The bottom portion of the middle region is tapered out by the swaging process and becomes the bottom region. The top region of the lower pole support section is formed by swaging a top portion of the middle region of the lower pole support section. The top portion of the middle region is tapered in by the swaging process and becomes the top region.

Briefly, in accordance with another aspect of the invention, another method for making the multi-sectional utility pole above comprises the steps of attaching the bottom region of the upper pole support section to the middle region of the same pole section, and attaching the top region of the lower pole support section to the middle region of the same pole section. The two regions of the upper pole support section are attached by welding the tapered bottom region to the middle region. This bottom region is initially separate from the middle region. The two regions of the lower pole support section are attached by welding the tapered top region to the middle region. This bottom region is initially separate from the middle region.

DESCRIPTION OF THE PREFERRED EMBODIMENT

Figure 1:
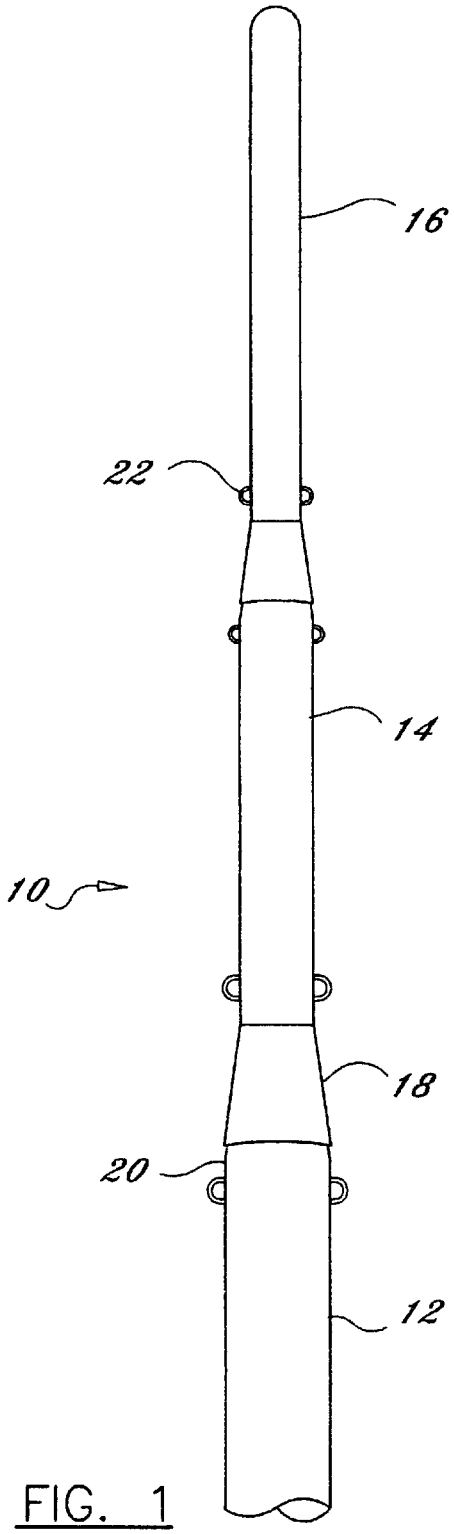
FIG. 1 is a front elevational view of a multi-sectional pole according to the present invention.

Referring to FIG. 1, according to the preferred embodiment, a pole 10 comprises three sections 12, 14, 16, which are not tapered uniformly. However, any number of sections are anticipated by the present invention. Each section 12, 14, 16 primarily consists of a straight section of pipe, which is not tapered at all. Each straight section of pipe, in this embodiment, has a narrower diameter than the one below it. At one or more ends of each section of pipe, there is a tapered portion 18, 20. At the bottom of each of the upper sections of the pole there is a female tapered portion, and at the top of each of the lower sections of the pole there is a male tapered portion.

These male and female tapered portions form a ferrule or slip joint. A slip joint is a friction fit wherein two sections of poles are slipped together, for example, with the female section being above the male section. Both sections have the same taper so that they will axially slide together a certain distance and then stop and, preferably, be tight and in contact along the entire length of the joint.

The preferred embodiment has several advantages over the prior art. All pole sections with pipe of a given diameter are fungible. This interchangeability allows easier and quicker unloading and assembling of the sections at a job site since every pole need not have specific sections, but only specific diameters.

As will be explained in greater detail below, the poles can be assembled in the horizontal position, that is, while the sections are still on the ground. This allows easier, quicker, less labor intensive, and also less dangerous assembly. The fact that pipe is relatively inexpensive compared with tapered cylinders, is another factor contributing to the low cost of the preferred embodiment as compared with the prior art.

In the preferred embodiment, the utility pole 10 is used, for example, as a light pole. However, a multitude of uses, both permanent and temporary, are possible with the pole 10 of the present invention. Some of these other uses include, but are not limited to, supporting telephone, cable, and electric lines, as well as loudspeakers, catch nets for driving ranges, and security cameras. Even the use as a light pole is variable, the pole being able to support highway luminaires, recreational lights for ballfields, tennis courts, etc., other outdoor lighting such as for parking lots, and many other uses.

Figure 2:
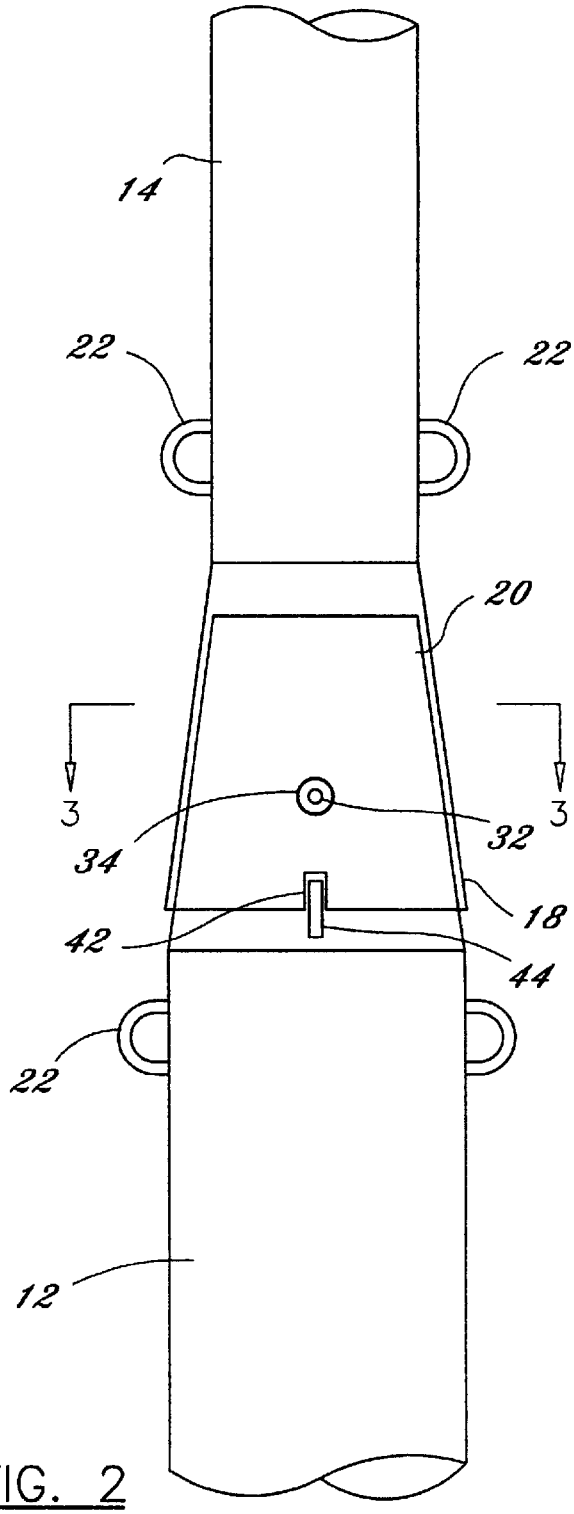
FIG. 2 is a front elevational view of a slip joint of the pole of FIG. 1.

Referring to FIG. 1, the pole 10 consists of three sections 12, 14, 16. However, a greater or smaller number of sections is possible. FIG. 2 is to contain all of the necessary specifications for a machinist to fabricate the pole. The relative dimensions of FIG. 2 are for convenience, and not believed to be critical or necessary for enablement.

As can be seen from FIG. 1, the majority of each section consists of a straight section of pipe, and, in one embodiment, the diameter of the pipe is smaller in each succeeding higher section of the pole. In the preferred embodiment, the pipe is round, hollow, and made of steel. As such, it is easily manufactured, as for example, by rolling. Such pipe is also quite strong and does not have the drawback of having a seam. Alternate embodiments may use pipe that has a polygonal, oval, or other non-circular cross-section. Additionally, the pole need not be hollow, nor made from steel. Depending on the application, each section of pole may be solid, partially solid, or otherwise internally reinforced or strengthened. The pole may also be made with one or more welded seams, such as by bending a single sheet and welding the longitudinal seam or by welding two half shells together.

Referring to FIG. 2, each section of the pole 12, 14 has a conical slip joint section 20, 18, respectively, attached to at least one respective end. Each slip joint is comprised of two slip joint sections for connection of the sections of the pole.

In the preferred embodiment, the slip joint is principally composed of a female part 18 that is mechanically coupled to the upper pole section 14, and a male part 20 that is mechanically coupled to the lower pole section 12. In a preferred embodiment, the female part 18 is designed to be substantially flush about its top circumference with the adjoining straight section of pipe from the same section 14, and the male portion 20 is designed to be substantially flush about its bottom circumference with the adjoining straight section of pipe from the same section 12. However, the female part and male part could be mechanically coupled to their respective straight section of pipe at other circumferences about their respective tapered joint sections (not shown). Both the female 18 and male 20 parts are designed to have substantially the same taper so that they will slide together a certain distance until they are tight and in substantial contact along the entire length of the overlap. The tapered parts 18, 20, thus act as a ferrule. The dimensions of the female 18 and male 20 parts are also important in designing a tight connection, and FIG. 6 contains a table showing several of the preferred dimensions for both the male 20 and female 18 parts of the slip joint. The diameters are outside diameters, "T" is the thickness of the material, and the length refers to the axial length through the middle of the cone, or slip joint section, from top to bottom. The thickness of the female and male parts varies as a function of the size of the parts. Alternative embodiments may employ different dimensions for the male and female parts and achieve essentially the same results.

In the preferred embodiment, the tapered male 20 and female 18 parts are uniformly tapered, such that their outside edges in the front elevational view of FIG. 2 appear to be linear. This is a relatively simple taper to construct and is easily attached to circular pipe sections. However, alternative embodiments may employ non-uniform tapers. The non-uniformity may be a function of the axial or longitudinal height, such as a bowl shaped slip section, or it may be a function of the angular position when viewed from above, such as a linear taper whose slope changes toward one side of the slip section so as to offset the centers of the two sections of the pole. As long as the basic requirement of being in substantial contact along the entire length of the overlap is satisfied, then virtually any taper will suffice. Additionally, the male and female parts will preferably, but not necessarily, be of the same perpendicular cross-sectional shape as the pipes to which they are adjoined. In the preferred embodiment, this is circular, but oval, polygonal, or other shapes are also possible.

In the preferred embodiment, the slip joint is made of A-36 grade steel plate with a minimum yield strength of 42 K.S.I. or greater. These cones 18, 20 are either rolled or mechanically formed and the connection welds are ultrasonically tested. The matching slip sections, that is, the male and female parts 18, 20 that meet and form a joint, are preferably welded at the end of the straight pipe thus allowing for a symmetrical joint connection. The top of the male part 20 may be further reinforced with a cover over the opening on the top of the male cone 20.

In alternative embodiments, the male and female parts may be constructed in a variety of methods. They may have no seams, one seam as when made from a sheet, two seams as when made from two half shells, or more. The slip sections may be welded onto the straight section of pipe, or otherwise affixed if another method better suits the materials used. Note that the slip sections may be affixed before or after they are fully formed. Additionally, the straight section of pipe may be swaged, such that the slip section is formed from the end of the section of pipe. The pipe, or other straight section of the pole, may be swaged inward or outward to produce either the male or female part, respectively. This method has the advantage that each section of the pole will have no seam and be one contiguous piece. For the male part the circumference of that section will be decreased toward the top of that section of the pole, and for the female part the circumference of that section of the pole will be increased toward the bottom of that section, where top and bottom refer to the orientation that the pole will have when it is assembled and erected.

Two sections of the pole 12, 14 are mounted or joined by axially fitting the female part 18 of the upper section 14 over the male part 20 of the lower section 12. In this instance, axially refers to the axis going through the center of the pole. It is also understood that the two sections 12, 14 of the pole which are being joined should have the appropriate dimensions such that the slip joint can be formed. The degree of overlap between the complementary slip joint sections 18, 20 depends on the design, but the female part 18 should receive and overlap with at least a portion of the male part 20.

To facilitate connecting two sections of the pole 10, the preferred embodiment has a set of rings 22 on each section. These rings 22 are located on the straight section of the pipe, and close to the slip joint section, as indicated in FIG. 2. Indeed, for sections of the pole that have a slip joint on both ends, there are two sets of rings 22, with one set at each end. The rings 22 are D-type rings and the two rings which form a given set are located at the same axial elevation, are aligned axially, and are spaced 180 degrees apart when viewed from the top. The rings 22 can be used with a variety of tools or mechanisms to apply axial, rotational, or lateral force to the sections of the pole. One common method is to use a turnbuckle, or other similar device such as a chain jack, cable jack, or come-along. The turnbuckle is attached to the rings 22 of at least one section, and preferably two sections, by using chain, cable, rope, or some other mechanism. The turnbuckle is then tightened to draw the two sections of the pole towards each other. Alternative embodiments may employ any other means for mounting, or for aiding the connecting of two sections of the pole, or may employ no means at all. Such other means include, but are not limited to, other types of rings, hooks, bars, prongs, slots, ridges, or grooves.

Figure 4:
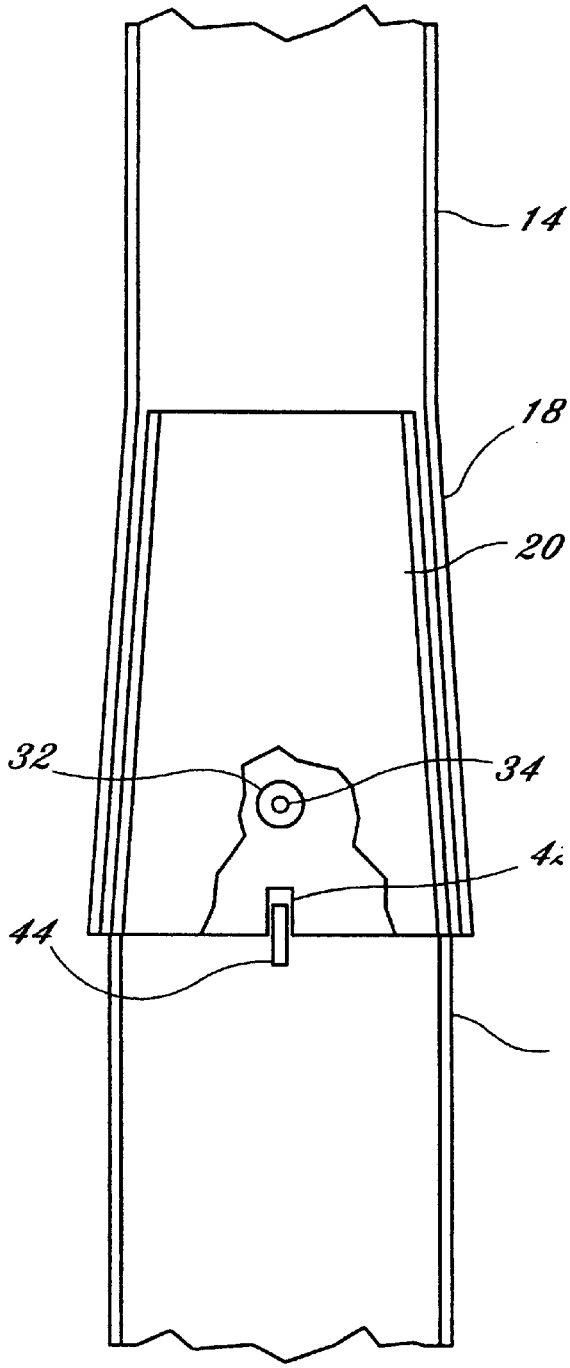
FIG. 4 is a front elevational view of the slip joint of FIG. 2 showing, in particular, a key and slot.

Before completing the mounting or connecting step, the sections 12, 14 of the pole may need to be properly aligned. The preferred embodiment makes provision for this by using a key, also called a notch or tooth, and a slot. As shown in FIGS. 2 and 4, a key 44 is attached to, or is an integral part of, the male part 20 of the slip joint. In a complementary fashion, a slot 42 is formed in the female part 18 of the slip joint. Both the key 44 and the slot 42 are aligned axially and serve as a guide in aligning the sections 12, 14 and as a lock as well. The rings 22 preferably are also placed at an equal and symmetric distance of 90 degrees from both the key 44 and the slot 42 so that the key 44 and slot 42 can be facing upward with the rings 22 on the periphery when the pole sections are in the horizontal position.

Alternative embodiments may employ one or more key and slot combinations, or any of a variety of other devices. Other means for aligning include, but are not limited to: a tongue and groove type of device which is also self-directing and locking once alignment is achieved; a pair of lines, with one on each slip joint section, allowing visual alignment as the sections are joined; the sides of a polygonal slip joint section or the shape of an oval slip section will also serve as an alignment means; a non-uniform taper, for instance with one side beveled; or a tapered section with a locking groove such as a spiral locking groove or a bayonet latch, with or without a detent. Some of the benefits of the preferred embodiment's key 44 and slot 42 are that they are continually visible as the sections 12, 14 get closer together, that they are self-locking to preserve the alignment before the pole is placed in a vertical position, and that they require no rotation of the sections 12, 14 to lock them in the proper alignment. Additionally, alternative embodiments may place the mounting means at different relative locations with respect to the alignment means.

Once aligned and joined, it may still be necessary to fasten the sections of the pole together. The preferred embodiment achieves this by fastening together the slip joint sections themselves. In addition to providing additional strength to the connection, the fastening means also ensures that the slip joint sections are indeed compressed completely before the entire pole is put in the vertical position. Once the pole is in the vertical position, the weight of the pole and any device that the pole may be supporting also serve to keep the pole sections from separating.

Figure 3:
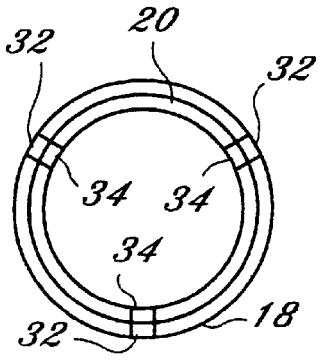
FIG. 3 is a cross-sectional view, taken perpendicular to the longitudinal axis of the pole of FIG. 1, of a slip joint at the point where the bolts are inserted.

Referring to FIGS. 2 and 3, the fastening means of the preferred embodiment consists of, for example, three ⅝" hex head bolts which are all inserted in the same perpendicular cross-section of the slip joint and are evenly spaced by 120 degrees when viewed from above, that is, axially. The alignment of these ⅝" hex head bolts is shown in FIG. 3, which is a cross-sectional view of the position on the pole where the hex head bolts are inserted. As can be seen, the bolts pass through the holes 32 in the female part 18 and are threaded into the holes 34 in the male part 20, the holes 34 in the male part 20 being aligned with the holes 32 in the female part 18 by rotating the pole sections 12, 14 using the rings 22 or some other means. The material and thickness of a slip section largely determine whether or not it can be tapped. Alternative embodiments need not thread the holes, or they may tap the holes through both the female and male parts.

An alternative embodiment may also use more, or fewer, bolts, which are: of different sizes from the preferred embodiment and even from each other if more than one bolt is used, at different and even non-equal angular spacing, and at different elevations from the preferred embodiment and possibly from each other if more than one bolt is used. Other means for fastening or securing the tapered cones may also be used, including but not limited to, screws, plugs, cotter keys or pins, other types of keys and pins, through-bolts, and other types of bolts or rods. While a through-bolt, that is, a bolt that goes all the way through the slip joint, may be used, there is a commonly known disadvantage. It is known that having holes which are directly opposite each other, that is, in the same cross-sectional plane and separated by 180 degrees, increases the likelihood that the pole will suffer a stress fracture.

Further, entirely different means of fastening may be employed. Such means may include, but are not limited to, using an adhesive or bonding agent between the slip joint sections, welding the perimeter of the overlapping female part to the male part, or employing a grooved or corkscrew type of taper, as mentioned earlier, that serves to keep the sections of the pole from being pulled apart.

As FIG. 1 indicates, the uppermost section 16 of a pole 10 will not need a male slip joint section. Similarly, the bottommost section 12 of a pole 10 will not need a female slip joint section, but it will need a base to secure the pole 10 to the ground or to whatever type of platform is being used. A variety of bases are known to those skilled in the art, and the design considerations will clearly depend on the size of the pole 10, its intended use, the environment it will be in, and other considerations. All pole sections other than the uppermost and bottommost section, however, will utilize both a female slip joint section (such as at the bottom) and a male slip joint section (such as at the top) of that section of the pole.

The slip joints are intended to be compressed while the pole 10 is in a horizontal position, that is, before the pole 10 is standing. In an alternative embodiment, the poles are attached one on top of each other while erected. The bottommost section is held securely in place and each successive top section is mounted on the conical taper of the preceding pole. If the sections are so equipped, they can be turned into place using rings 22 until the holes 32, 34 for the ⅝" hex head bolts are in alignment.

Although a specific embodiment of the invention has been disclosed, it will be understood by those having skill in the art that changes can be made to this specific embodiment without departing from the spirit and scope of the invention. The scope of the invention is not to be restricted, therefore, to the specific embodiment, and it is intended that the appended claims cover any and all such applications, modifications, and embodiments within the scope of the present invention.

CONE DIMENSION

| Joint | T | Length | Male Diameter Top | Male Diameter Bottom | Female Diameter Top | Female Diameter Bottom |
|---|---|---|---|---|---|---|
| 5–6" | 0.250" | 12.000" | 5.160" | 6.625" | 5.563" | 7.030" |
| 6–8" | 0.250" | 15.230" | 6.260" | 8.625" | 6.625" | 9.00" |
| 8–10" | 0.250" | 18.750" | 8.250" | 10.750" | 8.625" | 11.130" |
| 10–12" | 0.310" | 22.040" | 10.220" | 12.750" | 10.750" | 13.280" |
| 12–16" | 0.310" | 27.400" | 12.250" | 16.000" | 12.750" | 16.500" |
| 16–18" | 0.310" | 30.700" | 15.440" | 18.000" | 16.000" | 18.560" |
| 18–20" | 0.375" | 34.000" | 17.310" | 20.000" | 18.000" | 20.690" |
| 20–24" | 0.375" | 40.600" | 19.350" | 24.000" | 20.000" | 24.600" |

What is claimed is:

1. A pole, comprising:

a first pole section having:

a bottom region having a first longitudinal length, the bottom region having a substantially equal diameter along the first longitudinal length; and a first tapered section, the first tapered section having:

a distal end region;

a proximal end region opposite the distal end region, the proximal end region being attached to the bottom region of the first pole section;

a first longitudinal axis; and a diameter at the proximal end region which increases toward the distal end at a rate from approximately 0.080 inches to approximately 0.155 inches per lateral inch along the first longitudinal axis;

a second pole section having:

a top region having a second longitudinal length, the top region having a substantially equal diameter along the second longitudinal length; and a second tapered section, the second tapered section having:

a distal end region;

a proximal end region opposite the distal end region, the proximal end region being attached to the top region of the second pole section;

a second longitudinal axis; and a diameter at the proximal end region which decreases toward the distal end at a rate from approximately 0.080 inches to approximately 0.155 inches per lateral inch along the second longitudinal axis, the second tapered section being slidably engagable with the first tapered section.

2. The pole of claim 1, further comprising a first attachment member attached to the first pole section approximate the bottom region and a second attachment member attached to the second pole section approximate the top region, the first and second attachment members facilitating the slidable enablement between the first tapered section and the second tapered section.

3. The pole according to claim 1, further comprising:

a slot, the slot being provided as part of one of the first tapered section and the second tapered section; and a key, the key being provided as part of the other of the first tapered section and the second tapered section, the key being configured to engage with the slot.

4. The pole of claim 1, further comprising a fastener for fastening the first pole section to the second pole section.

5. The pole of claim 1, wherein the first tapered section and the second tapered sections each have a uniform taper.

6. The pole of claim 1, wherein the first tapered section and the second tapered sections each have a non-uniform taper.

7. The pole of claim 1, wherein the diameter of the first tapered section increases at the same rate as the rate at which the diameter of the second tapered portion increases.

8. The pole of claim 1, wherein the diameter of the first tapered section increases at a rate different from the rate at which the diameter of the second tapered portion increases.

9. A pole, comprising:

a first pole section having:

a bottom region having a first longitudinal length, the bottom region having a substantially equal diameter along the first longitudinal length; and a first tapered section of a first length, the first tapered section having:

a distal end region; and a proximal end region opposite the distal end region, the proximal end region being attached to the bottom region of the first pole section; and a second pole section having:

a top region having a second longitudinal length, the top region having a substantially equal diameter along the second longitudinal length; and a second tapered section of a second length, the second tapered section having:

a distal end region;

a proximal end region opposite the distal end region, the proximal end region being attached to the top region of the second pole section, the second tapered portion being slidably engagable with the first tapered portion, the first tapered portion and the second tapered portion being configured to substantially contact each other along substantially the entire first length and second length when engaged.

10. The pole of claim 9, further comprising a first attachment member attached to the first pole section approximate the bottom region and a second attachment member attached to the second pole section approximate the top region, the first and second attachment members facilitating the slidable engagement between the first tapered section and the second tapered section.

11. The pole according to claim 9, further comprising:

a slot, the slot being provided as part of one of the first tapered section and the second tapered section; and a key, the key being provided as part of the other of the first tapered section and the second tapered section, the key being configured to engage with the slot.

12. The pole of claim 9, further comprising a fastener for fastening the first pole section to the second pole section.

13. The pole of claim 9, wherein the first tapered section and the second tapered sections each have a uniform taper.

14. The pole of claim 9, wherein the first tapered section and the second tapered sections each have a non-uniform taper.

* * * * *